US006932878B1

(12) United States Patent
Hallam et al.

(10) Patent No.: US 6,932,878 B1
(45) Date of Patent: Aug. 23, 2005

(54) EXPLOSIVE COMPOSITIONS

(75) Inventors: Deirdre Hallam, Cwmbran (GB); Ronald E. Hollands, Gwent (GB)

(73) Assignee: BAE Systems plc, London (GB)

( * ) Notice: Subject to any disclaimer, the term of this patent is extended or adjusted under 35 U.S.C. 154(b) by 1826 days.

(21) Appl. No.: 07/727,386

(22) Filed: Jul. 5, 1991

Related U.S. Application Data

(63) Continuation of application No. 07/364,675, filed on May 11, 1989, now abandoned.

(30) Foreign Application Priority Data

May 11, 1988 (GB) ..... 8811127

(51) Int. Cl.[7] ..... C06B 45/10
(52) U.S. Cl. ..... 149/19.91; 149/92
(58) Field of Search ..... 149/19.91, 92

(56) References Cited

U.S. PATENT DOCUMENTS 3,740,279 A * 6/1973 Levering et al. ..... 149/19.91
3,759,765 A * 9/1973 Young ..... 149/19.91
3,857,826 A * 12/1974 Greene et al. ..... 149/19.91
3,888,707 A * 6/1975 Rothenstein ..... 149/19.91
3,959,042 A * 5/1976 McCulloch et al. ..... 149/19.91
4,092,187 A * 5/1978 Hildebrant et al. ..... 149/11
4,357,185 A * 11/1982 Ringbloom ..... 149/11
4,430,132 A * 2/1984 Painter ..... 149/11
4,747,892 A * 5/1988 Spencer ..... 149/18
4,842,659 A * 6/1989 Mezger et al. ..... 149/19.2

* cited by examiner

*Primary Examiner*—Michael J. Carone
(74) *Attorney, Agent, or Firm*—Nixon & Vanderhye P.C.

(57) ABSTRACT

A plastic mouldable explosive composition comprises a gelled binder and a particulate explosive filler contained in the binder, wherein the binder comprises a blend of polyethylene wax polymer together with a tackifying resin comprising a polyisobutene polymer. Desirably, the amount of the polyethylene wax polymer in the composition is in the range 2 to 35 percent by weight, the polyethylene polymer having a molecular weight in the inclusive range 3,000 to 15,000. Desirably, the polyisobutene polymer comprises a liquid polyisobutene having a molecular weight of from 500 to 7,000.

16 Claims, No Drawings

EXPLOSIVE COMPOSITIONS

This is a continuation of application Ser. No. 07/364,675, filed May 11, 1989, now abandoned.

BACKGROUND OF THE INVENTION

1. Field of the Invention

The present invention relates to explosive compositions, particularly plastic mouldable explosive compositions.

2. Discussion of the Prior Art

A known explosive composition manufactured by the present Applicants, which composition has been in service use by the UK Ministry of Defence for many years comprises RDX, a particulate high explosive filler, incorporated in a binder which comprises liquid paraffin gelled to form a grease together with other minor additives. This composition is detonator sensitive (ie does not require a booster initiation) and is a plastic material which may be moulded like putty under light pressure by the user into a desired shape eg to fill a cavity or to line an edge between mating surfaces.

This known composition suffers from the problems that the low molecular weight liquid components of the binder tend to migrate causing the composition to become brittle during its service life, the low temperature (−20° C.) mouldability of the material is poor and binder ingredients tend to exude at elevated temperatures.

SUMMARY OF THE INVENTION

It is the purpose of the present invention to provide a novel plastic mouldable explosive composition in which the aforementioned problems are reduced or eliminated.

According to the present invention there is provided a plastic mouldable explosive composition comprising a gelled binder and a particulate explosive filler contained in the binder, wherein the binder comprises a blend of a polyethylene wax polymer together with a tackifying resin comprising a polyisobutene polymer.

By a "polyethylene polymer" is meant a polymer comprising ethylene optionally copolymerised with one or more than other compounds, the ethylene content forming at least 50, desirably at least 90, percent by weight of the polymer.

By a "polyisobutene polymer" is meant polyisobutene optionally copolymerised with one or more other compounds, the isobutene content forming at least 50, desirably at least 90, percent by weight of the polymer.

DETAILED DISCUSSION OF PREFERRED EMBODIMENTS

The relative proportions of the components of the binder depend upon the grades of the components employed in the blend. The most suitable amount of the polyethylene wax polymer in the blend will in many cases be in the range 2 to 35 percent by weight especially when the polyethylene polymer has a molecular weight in the inclusive range 3,000 to 15,000. However, the amount of the polyethylene wax polymer may be present in an amount of up to 90 percent by weight of the blend with the tackifying resin when the polyethylene polymer has a low molecular weight, eg. in the range 3,000 to 7,000.

Any liquid polyisobutene having a molecular weight of from 500 to 7,000, preferably from 500 to 5,000 may be used in or as the tackifying resin.

Preferred compositions comprise binders including polyisobutene having a molecular weight of from 500 to 5000

0nd a polyethylene having a molecular weight of from 3000 to 13000, polyisobutene forming 85 percent by weight or more of the polyisobutene/polyethylene blend.

Optional additives to the binder blend in the explosive composition according to the present invention comprise:

(a) micrystalline wax forming up to 10 percent by weight of the binder;

(b) a plasticiser having a viscosity of less than 50 cst preferably less than 2 cst at 20° C. and having a melting point less than 0° C., the plasticiser forming up to 20 percent by weight of the binder;

(c) an anti-oxidant forming up to 1 percent by weight of the binder.

For example, a suitable plasticiser comprising a quantity of material selected from one or more known energetic plasticisers such as GAP (glycidyl azide polymer), BDNPA/F(bis-2,2-dinitropylacetal/formal), bis-(2,2-dinitropropyl) formal, bis (2,2,2-trinitroethyl)formal bis(2-fluoro-2,2 dinitroethyle)formal, diethylene glycol dinitrate, glycerol trinitrate, glycol trinitrate, triethylene glycol dinitrate, trimethylolethane trinitrate, butanetriol trinitrate, or 1,2,4-butanetriol trinitrate may be added to form the binder.

Alternatively, or in addition the binder may incorporate one or more known non-energetic plasticisers such as one or more esters of phthalic, adipic or sebacic acid. For example the optional plasticiser may comprise a dialkyl phthalate eg. dibutyl phthalate or diethyl phthalate or may be selected from triacetin, tricresyl phosphate, polyalkylene glycols and their alkyl ether derivatives, eg. polyethylene glycol, polypropylene glycol, diethylene glycol butylether and dioctyl sebacate.

As suitable optional anti-oxidant compounds polymerised trimethyl dihydroquinone; or 2,2'-methylene-bis (4-methyl-6-butylphenol); or pentaerythrityl-tetrakis(3,3,5-ditertbutyl-4-hydroxyp henyl)propionate may be incorporated in the binder in an extent of up to 1 percent, eg. about 0.5 percent, by weight of the binder.

Preferably at least 75% desirably at least 88% by weight of the explosive filler in the composition according to the present invention is constituted by one or more heteroalicyclic nitramine compounds. Nitramine compounds are those containing at least one N—$NO_2$ group. Heteroalicyclic nitramines bear a ring containing N—NO groups. Such ring or rings may contain for example from two to ten carbon atoms and from two to ten ring nitrogen atoms. Examples of preferred heteroalicyclic nitramines are RDX(cyclo-1,3,5-trimethylene-2,4,6-trinitramine, hexagen), HMX (cyclo-1,3,5,7-tetramethylene-2,4,6,8-tetranitramine, octogen and mixtures thereof. The filler may alternatively be selected from TATND (tetranitro-tetraminodecalin, HNS (hexanitrostilbene) NTO(3-nitro-1,2,4-thiazol-5one), and TATB 30 (triaminotrinitrobenzene).

Preferably, the explosive filler comprises from 50% to 100% by weight of RDX.

Other highly energetic filler materials may be used in place of or in addition to the compounds specified above. Examples of other suitable known highly energetic materials include picrite (nitroguanidine), aromatic nitramines such as tetryl, ethylene dinitramine, and nitrate esters such as nitroglycerine (glycerol trinitrate), butane triol trinitrate or pentaerythritol tetranitrate, trinitrotoluene (TNT), inorganic oxidisers such as ammonium salts, eg. ammonium nitrate or ammonium perchlorate, and energetic alkali metal and alkaline earth metal salts.

Known metallic fuels such as aluminium powder may be added to form part of the energetic solids filler, eg. forming 1 to 50 percent, eg. up to 30 percent by weight of the total composition. Alternative metal fuels include magnesium, magnesium/aluminiujm alloy. Metallic fuel is preferably included together with RDX or with RDX and ammonium perchlorate.

The amount of explosive filler incorporated in the binder in the composition according to the present invention depends upon the amount of the filler required to convert the binder from a gel into a plastic mouldable mass but the explosive filler content is conveniently in the range 50 to 95 percent by weight, desirably 85 to 90 percent by weight, of the explosive composition.

In the case where the explosive is RDX and the metallic fuel comprises aluminium, the metallic fuel preferably comprises up to 30 percent by weight of the total composition, being up to 52 percent by weight of the energetic filler in compositions having up to 88 percent by weight solids loading.

The compositions according to the present invention may be made by adding the polyethylene to the polyisobutene and other optional ingredients at a temperature above the melting point of the polyethylene and then mixing the two together until a homogeneous liquid is produced. The explosive filler is then added as a powder optionally in a water wet condition and optionally with a suitable single organic solvent added to the binder to facilitate processing. Following further stirring to give a further homogeneous mass the product is cast, pressed, extruded or rolled as appropriate into suitable shapes which are allowed to cool to room temperature (25° C.).

A compatible coupling agent, in an extent of up to 2 percent by weight of the overall composition, may be added during mixture of the filler with the binder to improve adhesion between the two.

Examples of suitable coupling agents are:

(1) silane coupling agents eg (i) 1,2-ethane-diamine, N-(ethynylphenylmethyl)-N-(3-trimethoxysilyl)propylmonohydrochloride or (ii) $CH_2{:}CHSi(OCH_2CH_2OCH_3)_3$ (2) organotitanate coupling agents eg isopropyltri (dioctylphosphate)titanate.

A compatible surfactant in an extent of up to 2 percent by weight of the overall composition may be added to improve workability. Examples of suitable surfactants include eg. (i) lecithin, (ii) polyoxyethylene(20)sorbitan esters, eg monolaurate, monopalmitate or mono-oleate; or (iii) dioctyl ester of sodium sulphonic acid or (iv) pentaerythritoldioleate (PEDO).

A compatible dye, in an extent of up to 0.5% by weight of the overall composition, may be added during mixture of the filler with the binder as an aid to concealment.

Explosive compositions embodying to the present invention show useful moulding properties similar to those shown by the known material mentioned above, but advantageously show reduced migration of liquid binder components (and hence brittleness) with ageing, reduced exudation at elevated temperatures and improved low temperature mouldability.

In addition, the hy-drophobic nature of the binder imparts greater stability, adhesion and workability when the explosive compositions are used underwater.

Examples of the preparation and properties of compositions embodying the present invention will now be described by way of example as follows.

Various suitable materials (the "gelled binder" specified above) were first prepared by the following method, Method A.

Method A

Polyisobutene (PIB), and other optional ingredients such as plasticisers and antioxidants but not the polyethylene were added to a mixing vessel at room temperature (20° C.). The vessel was heated to a temperature of 140° C., slow stirring being applied at temperatures above 80° C.

When the temperature reached 115–120° C. polyethylene was added in increments to form a homogenous fluid.

The composition formed was cast into moulds or storage vessels and allowed to cool.

Explosive compositions were prepared from the resulting binder materials produced by Method A according to either of the alternative Method B, Method C or Method D as follows.

An incorporator was heated to a temperature of 95–100° C.

Method B

The binder material was dissolved in an equal mass of solvent by heating at 60–80° C. with stirring to form a suitable lacquer.

The explosive filler eg RDX, including any optional additives such as coupling agent but not metallic fuel, was provided in a water wet condition in a mixer which was heated to a suitable elevated temperature, eg. 80–95° C. for RDX. Binder lacquer was then added carefully followed by stirring with heating then cooling and drying. After removal of water and solvent, any required metallic fuel, eg powdered aluminium, was added.

Method C

An incorporator was preheated at a temperature of 85 to 95° C. Increments of the solid explosive filler in water wet form and the binder were added at intervals followed by mixing of the ingredients after each addition. Water was removed optionally under vacuum and the mixture stirred until homogeneous. The mixture was cooled optionally under vacuum to room temperature stirring being continued during cooling, and then stored in a container for use.

Method D

About one half of the binder ingredients were added to an incorporation preheated to a temperature of 95–100° C.

A first increment of wetted nitramine was added and mixed for about 15 minutes at atmospheric pressure, allowing water to evaporate.

Further increments of wetted nitramine were added each being allowed to incorporate for 10–15 minutes before addition of the next. Loose powder of unmixed composition between additions was scraped down.

When all explosive has been added aluminium was put in if required, allowing each increment to incorporate for approximately 10 minutes with scraping down between additions.

The remaining presoftened binder was poured and then incorporated for approximately 1 hour with scraping down every 15–20 minutes. A vacuum was applied if required to ensure complete removal of water.

The material was removed from the mixer either whilst hot, or after first cooling to the desired temperature whilst mixing.

If curing ingredients were to be included the material was cooled to 60–80° C., curing ingredients were added and the resultant material mixed for 15–20 minutes before removal from the incorporator.

Examples of binders made by Method A are given in Tables 1 and 2 as follows.

TABLE 1

GELLED-POLYETHYLENE BINDER SYSTEMS COMPOSITION INGREDIENTS

| Example | Polyethylene | | Polyisobutene | | Antioxidant | |
|---|---|---|---|---|---|---|
| Number | Type | (% w/w) | Type | (% w/w) | (% w/w) | DOS |
| B1 | P2 | 7.5 | PIB1 | 92.0 | 0.5 | |
| B2 | P2 | 7.5 | PIB2 | 92.0 | 0.5 | |
| B3 | P2 | 7.5 | PIB2 | 92.0 | 0.5 | |
| B4 | P2 | 20.0 | PIB3 | 92.0 | 0.5 | |
| B5 | P2 | 22.0 | PIB3 | 77.5 | 0.5 | |
| B6 | P2 | 25.0 | PIB3 | 74.5 | 0.5 | |
| B7 | P2 | 27.0 | PIB3 | 72.5 | 0.5 | |
| B8 | P2 | 30.0 | PIB3 | 69.5 | 0.5 | |
| B9 | P2 | 35.0 | PIB3 | 64.5 | 0.5 | |
| B10 | P3 | 89.5 | PIB1 | 10.0 | 0.5 | |
| B11 | P3 | 89.5 | PIB2 | 10.0 | 0.5 | |
| B12 | P3 | 89.5 | PIB3 | 10.0 | 0.5 | |
| B13 | P1 | 59.5 | PIB1 | 40.0 | 0.5 | |
| B14 | P1 | 59.5 | PIB2 | 40.0 | 0.5 | |
| B15 | P1 | 59.5 | PIB3 | 40.0 | 0.5 | |
| B16 | P2 | 22.0 | PIB4 | 77.5 | 0.5 | — |
| B17 | P2 | 22.0 | PIB3 | 77.5 | 0.5 | — |
| B18 | P1 | 22.0 | PIB5 | 77.5 | 0.5 | — |
| B19 | P1 | 22.0 | PIB4 | 77.5 | 0.5 | — |
| B20 | P1 | 22.0 | PIB3 | 77.5 | 0.5 | — |
| B21 | P3 | 22.0 | PIB5 | 77.5 | 0.5 | — |
| B22 | P3 | 7.5 | PIB3 | 92.0 | 0.5 | — |
| B23 | P1 | 7.5 | PIB3 | 92.0 | 0.5 | — |
| B24 | P2 | 7.5 | PIB1 | 92.0 | 0.5 | — |
| B25 | P3 | 7.5 | PIB1 | 92.0 | 0.5 | — |
| B26 | P2 | 5.0 | PIB1 | 94.5 | 0.5 | — |
| B27 | P2 | 7.5 | PIB3 | 87.0 | 0.5 | 5 |
| B28 | P2 | 7.5 | PIB1 | 87.0 | 0.5 | 5 |
| B29 | P2 | 7.5 | PIB2 | 92.0 | 0.5 | — |

TABLE 2

GELLED-POLYETHYLENE/POLYISOBUTENE BINDER SYSTEMS PROPERTIES

| Example Number | TMD ($g/cm^3$) | Softening Point (° C.) | Penetration ($mm \times 10^{-1}$) |
|---|---|---|---|
| B1 | 0.906 | 21 | 273 |
| B2 | 0.911 | 23 | — |
| B3 | 0.916 | 28 | 253 |
| B4 | 0.915 | 34 | 218 |
| B5 | 0.915 | 35 | 228 |
| B6 | 0.915 | 94 | 223 |
| B7 | 0.915 | 94 | 213 |
| B8 | 0.915 | 98 | 200 |
| B9 | 0.915 | 98 | 178 |
| B10 | 0.907 | 100 | 8 |
| B11 | 0.907 | 101 | 6 |
| B12 | 0.908 | 98 | 5 |
| B13 | 0.906 | 96 | 11 |
| B14 | 0.908 | 96 | 11 |
| B15 | 0.910 | 101 | 10 |

| Example Number | Softening Point (° C.) | Penetration ($mm \times 10^{-1}$) |
|---|---|---|
| B16 | 96 | ) |
| B17 | 95 | ) |
| B18 | 60 | ) |
| B19 | 30 | ) |
| B20 | 89 | 4 ) |
| B21 | 87 | 25 ) |
| B22 | 94 | 53 ) |
| B23 | 25 | 72 ) |
| B24 | 87 | 55 ) |

TABLE 2-continued

GELLED-POLYETHYLENE/POLYISOBUTENE BINDER SYSTEMS PROPERTIES

| | | |
|---|---|---|
| B25 | 67 | 73 ) |
| B26 | 57 | 68 ) |
| B27 | 25 | 60 ) |
| B28 | 87 | 68 ) |
| B29 | 92 | 22 ) |

In Table 1 the Antioxidant is 2,2'-methylene-bis-(4-methyl-6-butylphenol).

In Table 1 the polyethylene is as follows:

Type P1: Molecular weight n8000.

Type P2: Molecular weight n12000

Type P3: Molecular weight n4000

In Table 1 the polyisobutene type is as follows:

Type PIB1: molecular weight n1300

Type PIB2: molecular weight n2100

Type PIB3: molecular weight n2400

Type PIB4: molecular weight n3800

Type PIB5: molecular weight n5800.

Type PIB6: molecular weight n780

Type PIB7: molecular weight n1000

In Table 1 DOS is the plasticiser dioctyl sebacate.

In Table 2 TMD is theoretical maximum density.

In Table 2 the softening point is measured according to the known standard ASTM D36-8 (British Standard BS4692:1972).

In Table 2 the penetration is measured according to the known standard ASTM-2884-82 using a 100 g weight and a 20 s drop at 25° C.

Examples of explosive compositions made by Method B or C using binder materials listed in Table 1 are listed in Tables 3 and 4 as follows.

TABLE 3

PLASTIC EXPLOSIVE COMPOSITIONS EMPLOYING GELLED-POLYETHYLENE/POLYISOBUTENE BINDERS COMPOSITION

| Explosive Composition Example Number | Binder Example Number | Solids % w/w | Loading % v/v |
|---|---|---|---|
| E1 | B2 | 88.0 | 78.8 |
| E2 | B1 | 88.0 | 78.7 |
| E3 | B5 | 88.0 | 78.8 |
| E4 | B9 | 88.0 | 78.8 |
| E5 | B16 | 88.0 | 78.8 |
| E6 | B17 | 88.0 | 78.7 |
| E7 | B18 | 88.0 | 78.8 |
| E8 | B22 | 88.0 | 78.6 |
| E9 | B23 | 88.0 | 78.6 |
| E10 | B24 | 88.0 | 78.6 |
| E11 | B26 | 88.0 | 78.6 |
| E12 | B25 | 88.0 | 78.6 |
| E13 | B27 | 88.0 | 78.7 |
| E14 | B28 | 88.0 | 78.6 |
| E15 | B28 | 88.0 | 78.6 |
| E16 | B5 | 88.0 | 78.8 |

TABLE 4

PLASTIC EXPLOSIVE COMPOSITIONS EMPLOYING GELLED-POLYETHYLENE/POLYISOBUTENE BINDERS PROPERTIES

| | TMD ($g/cm^3$) | Penetration ($mm \times 10^{-1}$) | Weight Loss on Ageing |
|---|---|---|---|
| E1 | 1.613 | 16 | 2.5 |
| E2 | 1.612 | 30 | 2.1 |
| E3 | 1.615 | 11 | .18 |
| E4 | 1.615 | — | .27 |
| E5 | 1.614 | — | 0.46 |
| E6 | 1.612 | 8 | 0.00 |
| E7 | 1.614 | 11 | — |
| E8 | 1.611 | 10 | — ) |
| E9 | 1.611 | 22 | ) |
| E10 | 1.610 | 28 | ) |
| E11 | 1.610 | 35 | ) |
| E12 | 1.610 | 27 | ) |
| E13 | 1.612 | 24 | ) |
| E14 | 1.610 | 31 | 1.10 ) |
| E15 | 1.610 | 87 | ) |
| E16 | 1.615 | — | — ) |

In Table 3 the solids loading comprises particulate RDX the remainder of the explosive composition being the binder material (eg. B1, B2 etc).

In Table 4 penetration is measured to the known standard ASTM-2284-82 using a 10 g weight and a 20 s drop at 25° C. dxn Table 4 ageing comprises 3 months at a temperature of 60° C.

In Table 4 the "Comments" relate to the properties of the explosive composition at 25° C.

Examples of hazard data for Examples E14 and E15 are as follows:

E14 figure of insensitiveness: 110 (RDX=80)

Mallet Friction (steel on steel) 0%

These tests are specified in Sensitiveness Collaboration Committee (SCC) Manual No 3.

What is claimed is:

1. A plastic mouldable explosive composition comprising:

a binder; and a particulate explosive filler contained in the binder, said binder comprises a gelled blend of a polyethylene wax polymer and a tackifying resin said polyethylene wax polymer having a molecular weight within the range of 3000 to 15,000 and comprised of at least 50% by weight of polymerized ethylene groups, said tackifying resin comprising a polyisobutene polymer having a molecular weight within the range of 500 to 7000 and comprised of at least 50% by weight of polymerized isobutene groups.

2. A plastic mouldable explosive composition as claimed in claim 1 wherein the polyethylene wax polymer comprises ethylene groups at least 90 percent by weight of the wax polymer.

3. A plastic mouldable explosive composition as claimed in claim 1 wherein the polyisobutene polymer comprises isobutene groups forming at least 90 percent by weight of the polyisobutene polymer.

4. A plastic mouldable explosive composition as claimed in claim 1 wherein the amount of the polyethylene wax polymer in the binder is in the range 2 to 35 percent by weight.

5. A plastic mouldable explosive composition as claimed in claim 1 wherein the polyethylene wax polymer has a molecular weight in the inclusive range 3,000 to 7,000 and the amount of polyethylene wax polymer in the binder is less than 90%.

6. A plastic mouldable explosive composition as claimed in claim 1 wherein the polyisobutene polymer comprises a liquid polyisobutene having a molecular weight of from 500 to 5,000.

7. A plastic mouldable explosive composition as claimed in claim 1 wherein said polyisobutene has a molecular weight of from 500 to 5000 and said polyisobutene forming at least 85 percent by weight of the binder.

8. A plastic mouldable explosive composition as claimed claim 1 and wherein the composition comprises as an additive to the binder one or more of the following;

(a) microcrystalline wax forming up to 10 percent by weight of the binder;

(b) a plasticiser having a viscosity of less than 50 cst at 20° C., the plasticiser forming up to 20 percent by weight of the binder;

(c) an anti-oxidant forming up to 1 percent by weight of the binder.

9. A plastic mouldable explosive composition as claimed in claim 1 and wherein at least 75% by weight of the explosive filler in the composition is constituted by one or more heteroalicyclic nitramine compounds.

10. A plastic mouldable explosive composition as claimed in claim 9 and wherein the explosive filler comprises from 50% to 100% by weight of RDX based on the total weight of filler.

11. A plastic mouldable explosive composition as claimed in claim 1 and wherein the explosive filler forms from 85 to 90 percent by weight of the explosive composition.

12. A plastic mouldable explosive composition as claimed in claim 1 and wherein the filler comprises from 1 to 52 percent by weight of a metallic fuel based on the total weight of filler.

13. A plastic mouldable explosive composition as claimed in claim 12 and wherein the filler comprises RDX as explosive and aluminium as metallic fuel, the aluminium comprising up to 52 percent by weight of the energetic filler.

14. A plastic mouldable composition as claimed in claim 1 and which comprises an explosive-to-binder compatible coupling agent in an extent of up to 2 percent by weight of the overall composition.

15. A plastic mouldable explosive composition as claimed in claim 1 and which includes a compatible surfactant in an extent of up to 2 percent by weight of the overall composition.

16. A plastic mouldable explosive composition as claimed in claim 1 and including a compatible dye, in an extent of up to 0.5% by weight of the overall composition.

* * * * *